US007472572B2

(12) United States Patent
Luckey, Jr. et al.

(10) Patent No.: US 7,472,572 B2
(45) Date of Patent: Jan. 6, 2009

(54) METHOD AND APPARATUS FOR GAS MANAGEMENT IN HOT BLOW-FORMING DIES

(75) Inventors: George Luckey, Jr., Dearborn, MI (US); Yingbing Luo, Ann Arbor, MI (US); Peter Friedman, Ann Arbor, MI (US)

(73) Assignees: Ford Global Technologies, LLC, Dearborn; Jaguar Cars Limited, Whitley (GB)

( * ) Notice: Subject to any disclaimer, the term of this patent is extended or adjusted under 35 U.S.C. 154(b) by 0 days.

(21) Appl. No.: 11/740,337

(22) Filed: Apr. 26, 2007

(65) Prior Publication Data

US 2008/0264131 A1 Oct. 30, 2008

(51) Int. Cl.
*B21D 26/02* (2006.01)

(52) U.S. Cl. ..... 72/57; 72/60; 29/421.1

(58) Field of Classification Search ..... 72/56, 72/57, 60, 347, 350; 29/421.1
See application file for complete search history.

(56) References Cited

U.S. PATENT DOCUMENTS 3,373,585 A * 3/1968 Reynolds ..... 72/57
4,754,635 A * 7/1988 van den Berg et al. ..... 72/347
5,974,847 A 11/1999 Saunders et al.
6,581,428 B1 6/2003 Friedman
6,880,377 B2 * 4/2005 Kim et al. ..... 72/57
6,910,358 B2 * 6/2005 Schroth ..... 72/57
7,047,779 B2 * 5/2006 Kruger et al. ..... 72/57
7,204,119 B2 * 4/2007 Kruger et al. ..... 72/350
7,210,323 B2 * 5/2007 Kruger et al. ..... 72/57
2005/0044917 A1 3/2005 Schroth
2005/0150266 A1 7/2005 Kruger et al.

FOREIGN PATENT DOCUMENTS

EP 1410856 6/2005

OTHER PUBLICATIONS

Search Report for the corresponding GB patent application No. GB0807016.1 mailed Jun. 30, 2008.

* cited by examiner

*Primary Examiner*—David B Jones
(74) *Attorney, Agent, or Firm*—Raymond L. Coppiellie; Brooks Kushman, P.C.

(57) ABSTRACT

A method and apparatus for forming a sheet of ductile material by superplastic forming is disclosed. The method is directed to first creating a pre-form by mechanical forming in which the pre-form is created with a die and punch. Thereafter the pre-form is subjected to gas pressure in a forming cavity to complete formation of the part. A metallic gasket is provided to ensure that no pressurized gas escapes from the forming cavity.

20 Claims, 3 Drawing Sheets

METHOD AND APPARATUS FOR GAS MANAGEMENT IN HOT BLOW-FORMING DIES

TECHNICAL FIELD

The present invention relates generally to the production of articles using superplastic forming. More particularly, the present invention relates to a method and apparatus utilizing a first step in which a pre-form is created with a die and punch and a second step in which the pre-form is subjected to gas pressure in a forming cavity to complete formation of the part. A metallic gasket is provided to ensure that no pressurized gas escapes from the forming cavity.

BACKGROUND OF THE INVENTION

The use of aluminum components in motor vehicles continues to expand due to the relatively good strength-to-weight ratio of this material. However, the expanded application of components made from this material is being hampered because of its limited temperature formability. One increasingly popular method of producing components from aluminum is superplastic forming in which certain materials, including particularly aluminum, are heated (under controlled temperature) and stretched slowly (under a controlled strain rate) to achieve dimensions that are well beyond their normal limitations. Superplastic forming offers a variety of advantages over conventional stamping techniques. Some of these advantages include increased forming strains, zero springback, and very low tooling costs. These alloys can be formed with relatively low forces and they permit a high level of detail in the design of the formed part.

Superplastic forming can result in very deep components which would rupture during the formation process by using conventional methods. The large degree of plastic strain that can be achieved with this process (>200%) makes it possible to form complex parts that cannot be shaped with conventional stamping techniques. As a result, the components produced by superplastic forming processes can embody relatively complex and highly integrated configurations. These components are not only lightweight but also exhibit a high degree of integrity, eliminating not only the number of parts and connectors, but also reducing the number of assembly operations because of the complexities that can be achieved.

Typical superplastic forming takes place in a simple one-sided, single action tool. The blank is clamped in a heated die and then blow formed with gas pressure into a female die. The part detail is captured within a single die rather than a matched pair and therefore tooling is significantly less expensive than that of conventional stamping. Furthermore, the low forces needed to form the material at these elevated temperatures allows for the use of cast iron dies instead of the harder to work and more expensive tool steel.

While superplastic forming may be a viable manufacturing option for some parts, there are limitations in the economic feasibility of this technique. Superplastic response in metals is inherently coupled with the rate of deformation and there exists only a narrow range of strain rates, typically slow strain rates, in which these materials display superplastic response. This results in a relatively slow cycle time which often leaves superplastic forming as a cost-prohibitive option for parts having volumes greater than 1000 parts per year.

Another problem related to SPF stems from the inability to draw material into the die cavity. Although the superplastic material utilized in SPF can undergo substantial deformation, its formability is limited to the amount of material in the die.

After the die faces are clamped and sealed, additional material cannot be drawn into the die. This may result in tears or inconsistent wall thickness in the part being formed. To overcome this, U.S. Pat. No. 5,974,847 introduces pre-forming the material around a punch before sealing the dies and completing the forming process by gas pressure injection. This approach reduces the amount of superplastic forming that takes place thereby reducing the cycle time and potentially allowing greater design freedom due to the additional material drawn into the die during the pre-forming step. While the method of this patent teaches pre-forming the material before the gas is injected, the method does not restrain the material entering the die during the pre-forming step. Without a restraining force on the material, such as blankholder force, the material will wrinkle around the punch in all but the simplest of formings. Wrinkling of the material during pre-forming will result in either the inability to complete the part during subsequent gas pressure forming or, at best, a low quality finished part.

In response to the need to reduce the problem of excessive wrinkling of the material during the pre-forming step, U.S. Pat. No. 6,581,428 introduced a method and apparatus which controls the amount of material flow during the forming process. Specifically, this patent teaches control of the amount of material being drawn into the die cavity during a pre-forming process so as to avoid wrinkling of the material.

While the method and apparatus of U.S. Pat. No. 6,581,428 improves the resulting product by reducing the number of wrinkles there is yet room for other advancements in the technology of superplastic forming. The present invention provides such advancement by allowing for significantly faster forming times, improved material utilization, more uniform thinning and the capability of using lower cost aluminum sheet.

SUMMARY OF THE INVENTION

The disclosed apparatus for the shaping a metal sheet into a formed product includes a movable upper die, a movable blankholder acted upon by a movable cushion plate, and a fixed lower plate having a pre-forming punch disposed on top of a spacer. A gas inlet is formed through the pre-forming punch. A metallic gasket is provided on the upper side of the lower die.

The disclosed apparatus is movable between a position for the shaping of a metal sheet. In its first operating position the movable upper die is moved to an open position in which the ductile material is placed on the upper surface of the movable blankholder and the upper surface of the punch. The ductile material must be heated to a forming temperature of between about 400° C. and 525° C. before it is shaped. Heating of the ductile material may be done externally before it is placed in the apparatus. Alternatively heating of material may take place within the apparatus after the sheet is put in position on the pre-forming punch and blankholder.

In the second operating position of the disclosed apparatus the upper die is moved downward to press upon the ductile material thus capturing the ductile material between the upper die and the blankholder.

In the third operating position the downward movement of the upper die continues effecting the downward movement of the blankholder and its associated movable cushion plate such that the lower side of the blankholder presses against the metallic gasket, thus pre-forming the part and creating a sealed chamber.

A gas is then injected into the sealed chamber and the formation of the part is completed. Once formation of the part is completed the apparatus is returned to its first operating position so that the finished part may be removed and a new sheet of ductile material may be put in position for forming.

An aspect of the present invention is to prevent the wrinkling of the finished part. This is achieved in part by providing a punch having side walls which are large relative to the inner forming surface of the upper die and the restraining walls of the blankholder. Using this configuration the gaps between the side walls of the punch and the inner forming surface of the upper die are reduced thus achieving a pre-form having edges that are more sharply defined than known in prior approaches to superplastic forming. Furthermore, the gap between the punch and the metal restrained in the blankholder is essentially removed, thus allowing better control of wrinkles. An additional aspect of having reduced tolerances between the walls of the punch and the inner forming surface of the upper die is that the pre-form (and hence the finished part) displays fewer wrinkles than those produced according to known technologies.

Other features of the invention will become apparent when viewed in light of the detailed description of the preferred embodiment when taken in conjunction with the attached drawings and the appended claims.

BRIEF DESCRIPTION OF THE DRAWINGS

For a more complete understanding of this invention, reference should now be made to the embodiment illustrated in greater detail in the accompanying drawings and described below by way of examples of the invention wherein.

DETAILED DESCRIPTION OF THE PREFERRED EMBODIMENT

Figure 1:
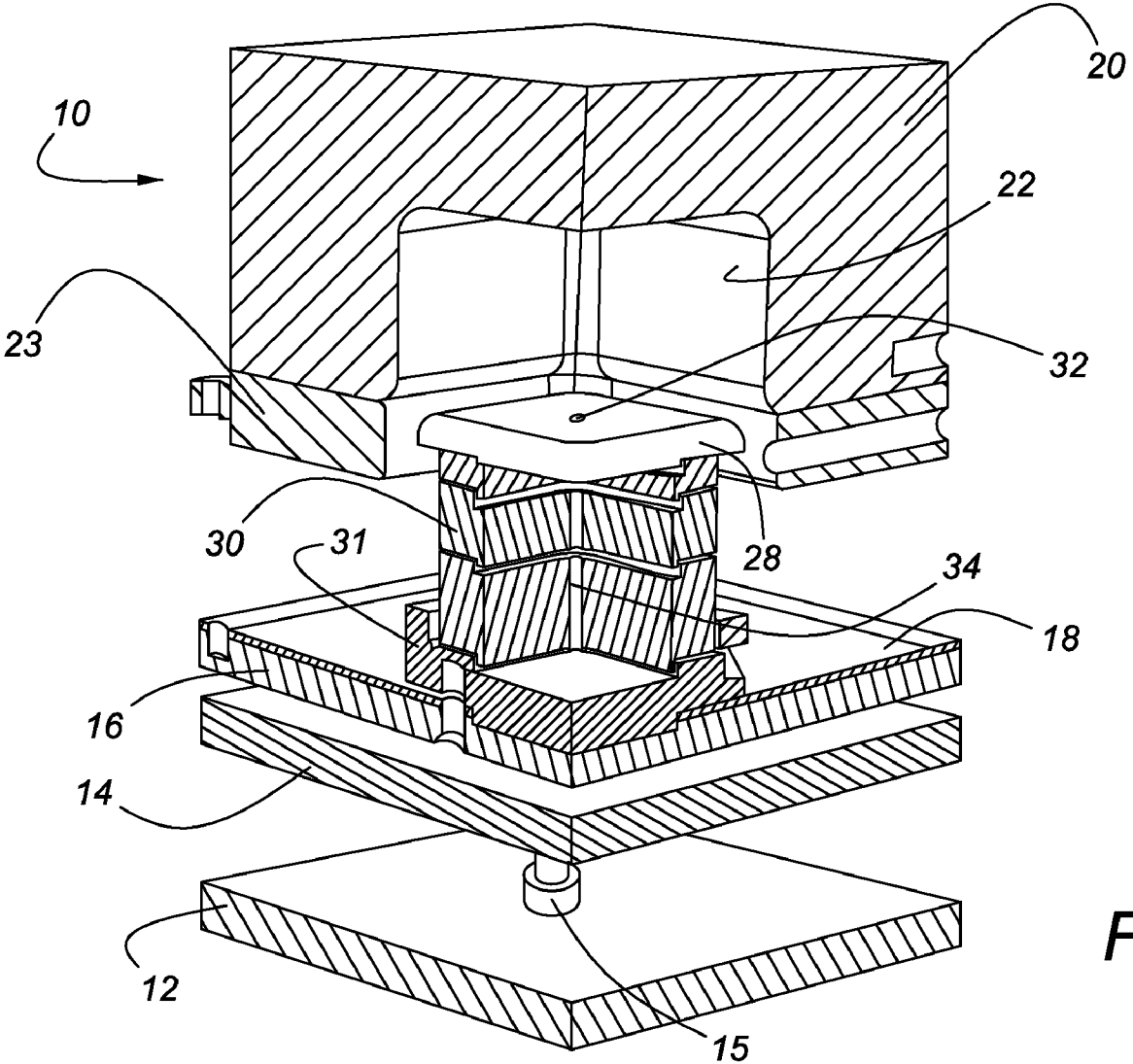
FIG. 1 is a quarter section view of a double-action mechanical pre-forming die according to the present invention.

In the following figures, the same reference numerals will be used to refer to the same components. In the following description, various operating parameters and components are described for one constructed embodiment. These specific parameters and components are included as examples and are not meant to be limiting.

With reference to FIGS. 1, a quarter section view of a double-action mechanical pre-forming die apparatus for superplastic forming of a sheet of highly ductile material in accordance with the present invention, generally illustrated as 10, is shown. The superplastic forming apparatus 10 includes a press base 12 which is fixedly mounted on a surface such as a floor (not shown). Spaced apart from the press base 12 is a movable cushion plate 14. Referring to FIGS. 1 through 4, the cushion plate 14 is movably supported by the press base 12 by one or more cylinders 15 and 15'. Two cylinders are shown, but it is understood that more cylinders can be used, depending on the need and application. As an alternative, coil springs, gas cylinders or similar resistive devices can be used.

The apparatus 10 further includes a lower die 16. The lower die 16 is laterally supported by a frame or other support structure (not shown) and is fixed in a non-movable position relative to the press base 12.

A metallic gasket 18 is positioned on the upper surface of the lower die 16. Prior to placement on the lower die 16, both sides of the metallic gasket 18 are treated with a release agent suited for elevated temperatures, such as boron nitride.

The superplastic forming apparatus 10 of the present invention further includes an upper die 20. The upper die 20 is vertically movable with respect to the lower die 16. As illustrated, the upper die 20 includes a forming surface 22 against which the sheet of ductile material is pressed to form the final shape of a workpiece to be produced. In an alternative configuration, the forming surface could be defined in the lower die 16. The upper die 20 can be fabricated from cast iron resulting in savings in tooling costs.

The superplastic forming apparatus 10 additionally includes a blankholder 23. The blankholder 23 is vertically movable and is fixed to the movable cushion plate 14 by a pair of cushion pins 26 (illustrated in FIGS. 2 through 4). The cushion pins 26 pass through the lower die 16.

The blankholder 23, the movable cushion plate 14 and the pair of cushion pins 26 move vertically as a cushion assembly. The movable cushion plate 14 rests upon the pair of gas cylinders 15 and 15'.

Because the material to be formed must be highly ductile, forming typically takes place at elevated temperatures. Accordingly, the lower die 16, the upper die 20, the blankholder 23 and the ductile material must be heated to a predetermined temperature prior to forming. This predetermined temperature depends on the composition of the alloy to be formed. To heat the lower die 16, the upper die and the blankholder 23 electrical resistance is directly or indirectly applied to these components through supporting elements (not shown). The heat is communicated to the ductile material.

Typical materials to be formed in the superplastic forming apparatus 10 are aluminum-magnesium alloys such as alloy 5083 or 5182. These aluminum alloys have a nominal composition, by weight, of 4.0% to 5.0% magnesium and 0.25% to 1.0% manganese. Other additions include smaller amounts of chromium and copper. These alloys would be formed over a temperature range of 375° C. to 475° C.

A pre-form punch 28 is disposed on the lower die 16 and is supported by a riser 30. The riser 30 is mounted on a punch base 31 which is itself fixedly disposed on the lower die 16. A portion of the metallic gasket 18 is captured between the punch base 31 and the lower die 16 as illustrated in FIGS. 1 through 4. The riser 30 can be used to adjust the elevation of the punch 28 as desired for the particular forming application. The punch 28 can take a variety of different configurations depending on the final shape of the work-piece. The punch 28 may also be placed in the upper die 20 in an alternative embodiment.

The sides and top of the punch 28 are configured in association with the ceiling and walls of the forming cavity 22 of the upper die 20 so as to provide a selected closeness therebetween. The distances between the top of the punch 28 and the ceiling of the forming cavity 22 and between the sides of the punch 28 and the walls of the forming cavity 22 may be adjusted as desired to increase or decrease tolerances. However, the objective is to make the fit between the sides of the punch 28 and the walls of the forming cavity 22 as close as possible so as to better define the configuration of the preformed part while minimizing wrinkling of the part. To achieve this at least some portions of the punch 28 are spaced about 10 mm or less from the inner wall of the forming cavity and the inner wall of the blankholder 23.

The punch 28 includes a gas passage 32 that provide pressurized gas used in the forming process. The gas passage 32 is in fluid communication with a gas delivery line 34 formed through the riser 30 and through the bottom plate 14 or lower die 16 to provide pressurized gas to the gas passage 32. While a single gas passage 32 is illustrated, the number of passages 32 may be adjusted as desired and as known to one skilled in the art.

Figure 3:
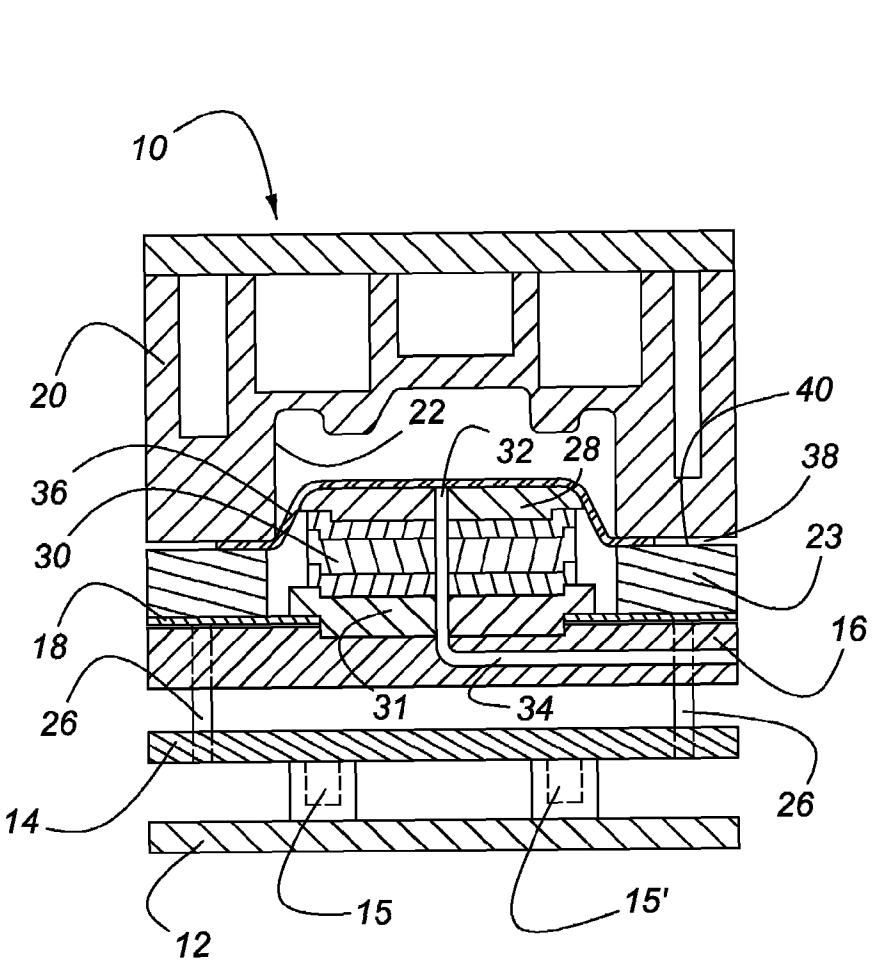
FIG. 3 is a cross-sectional view similar to that of FIG. 2 but illustrating the upper die in its lowered position with the material being drawn into the forming cavity to create the pre-form.
Figure 2:
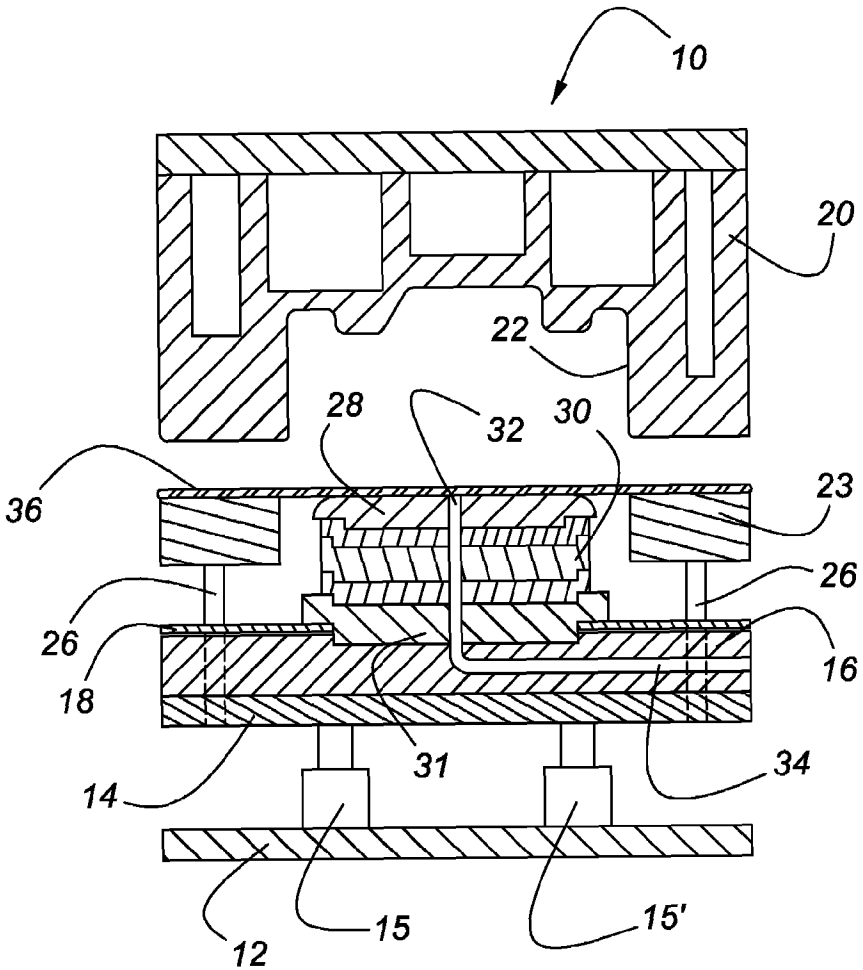
FIG. 2 is a cross-sectional view illustrating the double-action mechanical pre-forming apparatus at its first step where the blank is placed on the blankholder.
Figure 4:
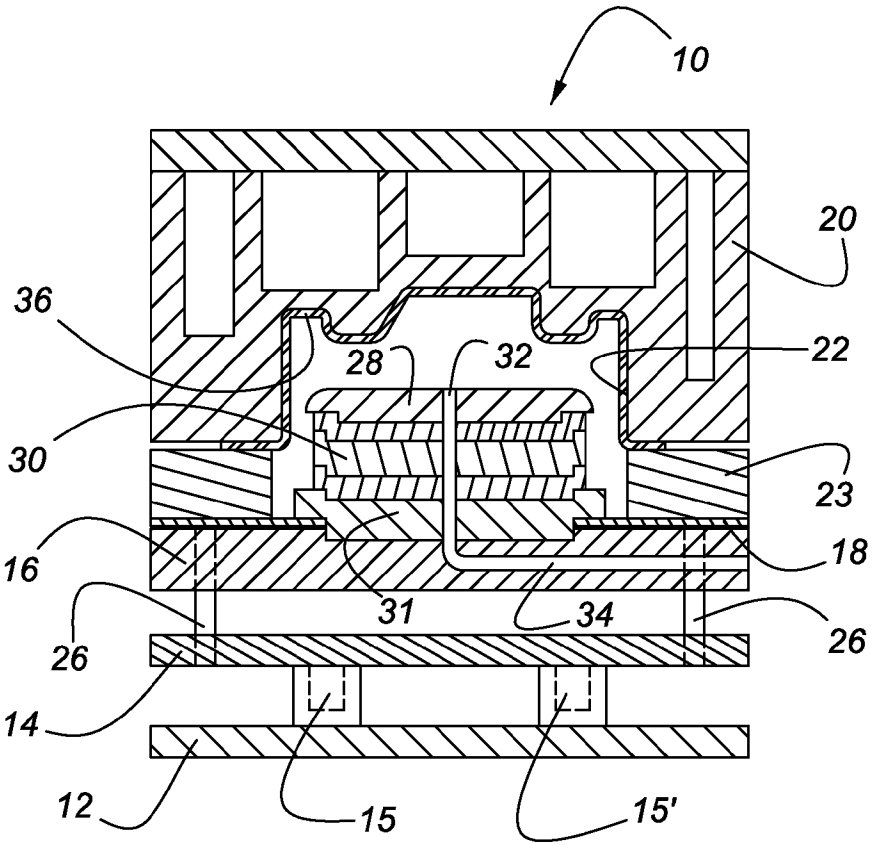
FIG. 4 is a cross-sectional view similar to that of FIG. 3 but illustrating the die being sealed and gas pressure introduced to complete the formation of the part.

A method of superplastic forming using the superplastic forming apparatus 10 of the present invention is set forth in FIGS. 2 through 4. With reference thereto, the progression of steps of the forming process in accordance with the present invention is illustrated.

With reference to FIG. 2, the superplastic performing apparatus 10 of the present invention is in its first operating position in which the blankholder 23 is moved to its raised position in which the upper surface of the blankholder 23 is generally flush with the upper surface of the punch 28. As illustrated, the gas cylinders 15 and 15' are in their extended positions and the associated bottom plate 14 is also set to its raised position. In addition, the upper die 20 has been moved to its raised position. In this manner the apparatus 10 is open to receive a sheet of ductile material 36 which is placed on the upper surfaces of the blankholder 23 and the punch 28.

With reference to FIG. 3, the upper die 20 is lowered to a position until its lower surface comes into contact with the sheet of ductile material 36. This is the second operating position of the apparatus. To achieve this position, the upper die 20 continues to move in a downward direction and applies downward pressure onto the blankholder 23 which, together with the cushion plate 14, is moved downward until the underside of the blankholder 23 rests upon the metallic gasket 18. The gas cylinders 15 and 15' are moved to their compressed positions as illustrated in FIG. 3. The controlled downward force on the sheet of ductile material 36 permits the sheet 36 to flow into the forming cavity 22 during this pre-forming step. The flow of the sheet 36 into the forming cavity can be seen at reference numeral 38 in FIG. 3 wherein the ends 40 of the sheet 36 are spaced a distance from the outer edges of the blankholder 23. Consequently, the amount of sheet material 36 drawn into the forming cavity 22 during this pre-forming stage is directly related to the amount of extensive force (the tonnage being between about 2 and 20 or more) applied by the downward movement of the upper die 20 and the blankholder 23. The cushion assembly 26 provides resistance to the opposing force of the downward-moving upper die 20. The cushion assembly 26 effectively bottoms out once the gas cylinders 15 and 15' are substantially in their compressed positions as illustrated in FIG. 3. The mechanical pre-forming deformation of the part is finished.

In FIG. 4 the next operating position of the present invention is illustrated. In this step the amount of press tonnage is increased to fully seal the forming cavity 22 in preparation to receive the forming pressurized gas. Both the metallic gasket 18 and the sheet of ductile material 36 seal the forming cavity 22 and act to prevent leakage of the forming gas. This is the die pressure sealed position in the method of the present invention. At this point the formation of the part can be completed by the application of superplastic gas pressure. A high pressure gas is injected into the underside of the sheet of material 36 by way of the gas delivery line 34, into the gas passage 32. This pressure forces the preformed material to conform to the configuration of the forming cavity 22 thus producing the desired shape of the finished part. The sheet of material 36 and the metallic gasket 18 ensure that no gas leakage from the forming cavity 22 will occur. During this step, the force on the upper die 20 scales with the gas pressure to avoid gas leakage from the forming cavity 22.

Once the part is formed, the upper die 20 is raised. Concurrently, the blankholder 23 and the cushion plate 14 also return to their raised positions as illustrated in FIG. 2. The cycle discussed with respect to FIGS. 2 through 4 can then be repeated.

Figure 5:
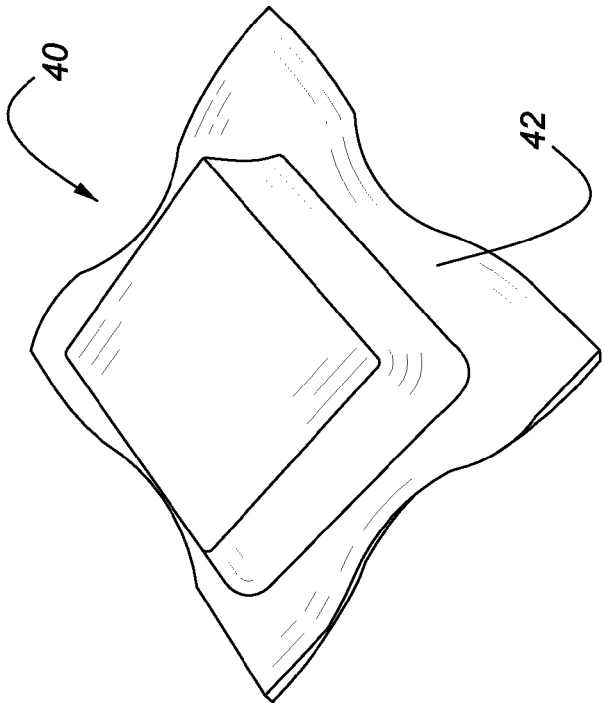
FIG. 5 is a perspective view of a component formed using the method and apparatus of the present invention.

A properly formed part 40 produced according to the method and apparatus 10 of the present invention is illustrated in FIG. 5. The part 40 includes a flange 42. As can be seen, the corners of the part 40 are relatively sharp and well-defined, while the flange 42 is free from wrinkles.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. An apparatus for shaping a metal sheet into a formed product, the apparatus comprising:

an upper die having an open area defined therein;

a lower die;

a blankholder positioned between the upper die and the lower die, the blankholder having an open area defined therein, the open area of the upper die and the open area of the blankholder being combinable to form a metal-shaping cavity;

a fluid seal disposed between the upper die and the lower die; and a punch assembly being operatively associated with the lower die;

wherein the punch assembly is fixedly positioned on the lower die and wherein the upper die and blankholder move toward the lower die to position the punch assembly in the metal-shaping cavity.

2. The apparatus for shaping a metal sheet according to claim 1 where the punch assembly fills a majority of the metal-shaping cavity when the punch assembly is substantially positioned within the metal-shaping cavity.

3. The apparatus for shaping a metal sheet according to claim 1 wherein the fluid seal is positioned between the blankholder and the lower die.

4. The apparatus for shaping a metal sheet according to claim 1 wherein the lower die has a recessed region formed therein within which a portion of the punch assembly is positioned.

5. The apparatus for shaping a metal sheet according to claim 1 wherein at least a portion of the fluid seal is captured between the punch assembly and the lower die.

6. The apparatus for shaping a metal sheet according to claim 1 wherein the fluid seal is a gasket.

7. The apparatus for shaping a metal sheet according to claim 6 wherein the gasket is a metallic gasket.

8. The apparatus for shaping a metal sheet according to claim 1 wherein the punch assembly includes a punch, a punch base, and a punch riser fitted between the punch and the punch base, the punch base being fixed to the lower die.

9. The apparatus for shaping a metal sheet according to claim 1 wherein the punch assembly has a side wall and the metal-shaping cavity has a side wall, the side wall of the punch assembly having portions being spaced apart less than about 10 mm from the side wall of the metal-shaping cavity when at least a portion of the punch assembly is positioned within the metal-shaping cavity.

10. An apparatus for shaping a metal sheet into a formed product, the apparatus comprising:

a first die assembly having a metal-shaping cavity defined therein;

a second die assembly;

a punch base fixedly disposed on the second die assembly; and a punch assembly disposed on the punch base and positionable substantially within the metal-shaping cavity; and a fluid seal disposed between the first die assembly and the second die assembly and between the second die assembly and the punch base.

11. The apparatus for shaping a metal sheet according to claim 10, wherein the first die assembly includes an upper die and a blankholder, the metal-shaping cavity being defined by open spaces formed in both the upper die and the blankholder.

12. The apparatus for shaping a metal sheet according to claim 11 wherein the fluid seal is positioned between the blankholder and the second die assembly.

13. The apparatus for shaping a metal sheet according to claim 10 wherein the second die assembly has a recessed region formed therein within which a portion of the punch assembly is positioned.

14. The apparatus for shaping a metal sheet according to claim 10 wherein at least a portion of the fluid seal is captured between the punch assembly and the second die assembly.

15. The apparatus for shaping a metal sheet according to claim 10 wherein the fluid seal is a gasket.

16. The apparatus for shaping a metal sheet according to claim 15 wherein the gasket is a metallic gasket.

17. The apparatus for shaping a metal sheet according to claim 10 wherein the punch assembly includes a punch, a punch base, and a punch riser fitted between the punch and the punch base, the punch base being fixed to the second die assembly.

18. The apparatus for shaping a metal sheet according to claim 10 wherein the punch assembly has a side wall and the metal-shaping cavity has a side wall, the side wall of the punch assembly being spaced apart less than about 10 mm from the side wall of the metal-shaping cavity when at least a portion of the punch assembly is positioned within the metal-shaping cavity.

19. A method for shaping a metal sheet into a formed product, the method comprising the steps of:

forming a metal shaping apparatus including an upper die, a blankholder, a lower die, a fluid seal fitted between the blankholder and the lower die, a punch assembly, and a metal-shaping cavity formed within the upper die and the blankholder;

placing the metal sheet onto the blankholder and the punch assembly;

lowering the upper die until it contacts the metal sheet;

lowering the upper die and the blankholder until the blankholder contacts the fluid seal to pre-form the formed product;

substantially filling the metal-shaping cavity with a metal-forming fluid to complete the formation of the formed product;

and removing the formed product from the metal shaping apparatus.

20. The method of claim 19 further including the step of heating the metal sheet prior to the step of lowering the upper die and the blankholder.

* * * * *